US005154153A

United States Patent [19]

MacGregor

[11] Patent Number: 5,154,153

[45] Date of Patent: Oct. 13, 1992

[54] FUEL TREATMENT DEVICE

[76] Inventor: Donald C. MacGregor, 13 Hunters Trail, Warren, N.J. 07059

[21] Appl. No.: 591,156

[22] Filed: Sep. 13, 1991

[51] Int. Cl.[5] ..... F02M 27/00

[52] U.S. Cl. ..... 123/538; 123/536

[58] Field of Search ..... 123/536, 537, 538, 539

[56] References Cited

U.S. PATENT DOCUMENTS

| | | | |
|---|---|---|---|
| 3,597,668 | 8/1971 | Yoshimine | 123/538 |
| 374,067,685 | 1/1978 | Brown | 123/536 |
| 4,515,133 | 5/1985 | Roman | 123/538 |
| 4,594,969 | 6/1986 | Przybylski | 123/536 |
| 4,930,483 | 6/1990 | Jones | 123/538 |
| 5,044,347 | 9/1991 | Ullrich | 123/538 |
| 5,048,499 | 9/1991 | Daywalt | 123/538 |
| 5,069,190 | 12/1991 | Richards | 123/538 |

*Primary Examiner*—E. Rollins Cross

*Assistant Examiner*—M. Macy

[57] ABSTRACT

Liquid fuels for internal combustion engines burn more completely after passing across and between metallic surfaces that can electrically polarize the fuels with a temporary electrostatic charge. The placement of the activating components of the fuel line close to the engine permits the fuels to be passed into the engine with the developed electrostatic potential that more rapidly dissociates the fuel molecules during their mixing with air prior to the ignition of the air and fuel mixture.

The described liquid fuel treatment device activates the fuels to improve the combustion efficiency resulting in increased engine performance, more power, better fuel economy, easier and quicker starting, reduced knock, a lower octane requirement, a cleaner engine, lower maintenance costs; while achieving lower levels of the regulated engine exhaust emmissions.

7 Claims, 1 Drawing Sheet

FUEL TREATMENT DEVICE

FIELD OF THE INVENTION

The present invention provides an improved liquid fuel treatment device for internal combustion engines which activates the fuel resulting in improved fuel combustion and lower levels of regulated exhaust emissions.

BACKGROUND OF THE INVENTION

It has been shown that liquid fuels, including gasoline and diesel fuel, for internal combustion engines burn more completely after passing the fuels across material surfaces that can electrically polarize the fuels with an electrostatic charge.

In U.S. Pat. No. 3,597,668, Yoshimine teaches the use of a rolled metal sheet, or mesh, core coated with a semiconductor film.

In U.S. Pat. No. 4,429,665, Brown passes the fuel in contact with an alloy metal bar which promotes a turbulent flow and charges the fuel.

In U.S. Pat. No. 4,715,325, Walker flows the fuel into intimate contact with a crystalline metal alloy affecting the fuel such that more complete burning of the fuel is achieved.

In U.S. Pat. No. 4,930,483, Jones discloses a fuel treatment device comprising an aluminum housing within a housing with a metallic alloy core causing non linear turbulent flow of the fuel to achieve a more complete treatment.

In U.S. Pat. Nos. 4,959,155 and 5,013,450 Gomez passes a fuel in contact with a solid metallic elongated body alloy to obtain a purification of the fuel.

The burn efficiency of a liquid fuel has been shown to improve by providing intimate contact between the fuel and appropriate materials within the fuel flow line to an internal combustion engine. By placement of the activating materials close to the engine, the fuels can then be passed into the engine with a developed electrostatic potential that more rapidly dissociates the fuel molecules during their mixing with air prior to ignition of the air and fuel mixture.

SUMMARY OF THE INVENTION

It is the object of this invention to provide an improved burn efficiency for a liquid fuel in an internal combustion engine.

This will result in increased engine performance, more power, better fuel economy, easier and quicker starts, reduced knock, a lower fuel octane requirement, a cleaner engine, lower maintenance costs, and lower levels of regulated exhaust emissions.

This is accomplished by the use of the elemental metals most appropriate for the fuel to be burned in combination with a more complete and lengthy contact between the metals and the fuel.

The suitable metals include aluminum, antimony, arsenic, barium, beryllium, bismuth, cadmium, calcium, cesium, chromium, cobalt, copper, gallium, gold, hafnium, indium, iridium, iron, lead, lithium, magnesium, manganese, mercury, molybdenum, nickel, niobium, osmium, palladium, platinum, potassium, rhenium, rhodium, rubidium, ruthenium, silver, sodium, strontium, tantalum, thallium, thorium, tin, titanium, tungsten, vanadium, ytterbium, yttrium, zinc, and zirconium. From these elemental metals, a group comprising a number of metals is selected; e.g., wherein at least seven metals from a preferred set are used in combination.

A further limitation would select, from the above group, a smaller group of elemental metals, comprising a number of metals; e.g., wherein at least six metals are used in combination from the group of aluminum, barium, beryllium, cadmium, chromium, cobalt, copper, gold, hafnium, indium, iridium, iron, magnesium, mercury, molybdenum, nickel, niobium, osmium, palladium, platinum, potassium, rhenium, rhodium, rubidium, ruthenium, silver, sodium, strontium, tantalum, thorium, titanium, tungsten, vanadium, yttrium, zinc, and zirconium.

The fuel treatment device made from one of these groups of metals will include a housing, and a core within the housing, for placement within a fuel line, with housing ends to attach to mating ends of the fuel line, and with a passageway through the housing ends, into the housing, to permit fuel flow through the housing, across the core, and out of the housing and into the engine.

The device is to be placed within the fuel line at the most suitable location adjacent to the engine, without grounding the device, to permit quick delivery of the activated fuel to the engine. A shielding mechanism can be added outside the housing to block magnetic and electromagnetic fields.

The fuel treatment device of this invention more effectively activates the fuel by a combination of:

a) passing the fuel through a tortuous route with extensive surface area, and b) passing the fuel across or between one or more surfaces of dissimilar metallic content.

A preferred embodiment of the present invention has adjacent surfaces of dissimilar metallic content, wherein the surfaces have a plurality of elemental metals that differ in content from each other, and wherein the fuel will pass between the dissimilar surfaces, e.g. wherein a core consists of parallel metal sheets with one side of one sheet coated with a plurality of metallic particles and the adjacent side of another sheet is coated with a plurality of metallic particles not the same as those of the first side. Likewise, a sheet may be coated with dissimilar surfaces of a plurality of elemental metal particles on both sides such that when the sheet is rolled into a coil, the sides presented to each other differ in their plurality of exposed metal particles.

In another preferred embodiment, the inner surface of the housing provides an exposed surface with a plurality of dissimilar metals, while the core provides an exposed surface with a plurality of dissimilar metals that differs from those of the housing.

In this last embodiment, a preferred configuration has the inner surface of the housing, and the outer surface of the core, each sculptured extensively such that they are mutually compatable to assembly, and to providing an appropriate tortuous passageway for the fuel. This passageway can be in the form of a screw thread.

A simplified form will have a screw thread on the inside of the housing with a solid round, or rolled sheet or mesh, core inserted.

A more simplified form will have a housing, without a core, wherein the housing is internally sculptured into a desirable passageway form, which can be in the form of a screw thread. This one piece form can be cast from an alloy, or otherwise manufactured, and then coated on its internal surface with elemental metal particles.

Another one piece form can be a cast core, without a housing, of a suitable exterior surface configuration that can be placed into an existing fuel line; or, it can be a rolled sheet or mesh core placed securely into a fuel line.

As this family of devices will become part of an internal combustion engine system for anything from a motor scooter to an aircraft carrier, many forms will be used. Rocket fuel engines and multi-fuel military engines will be a special challenge.

DESCRIPTION OF THE INVENTION

A metal housing, and a metal core, separately, or in combination, with surfaces from a selected group of elemental metals, polarize the molecules of a fuel with an electrostatic charge resulting in a more rapid dissociation of the molecules when the fuel is mixed with air prior to the mixture ignition, which provides a more complete combustion of the fuel.

A turbulent flow pattern across these surfaces, as well as increased surface area, enhances the quantity of the polarization.

As the electrostatic charge decays rapidly, the fuel is treated as close to the air-fuel mixture site, such as a carburator or fuel injectors, as is practical.

The fuel can be burned with any suitable substance, such as air or oxygen.

The primary focus of this invention is for liquid fuels, such as gasoline and diesel fuels, as burned within an internal combustion engine.

The core will be housed longitudinally within a nonmagnetic housing; such as of copper or aluminum, or a fuel line hose.

The surface composition of the metal parts of the device, as presented to the fuel, is the essence of the invention.

The design and metal selection will be customized to the requirements of the application.

Figure 1:
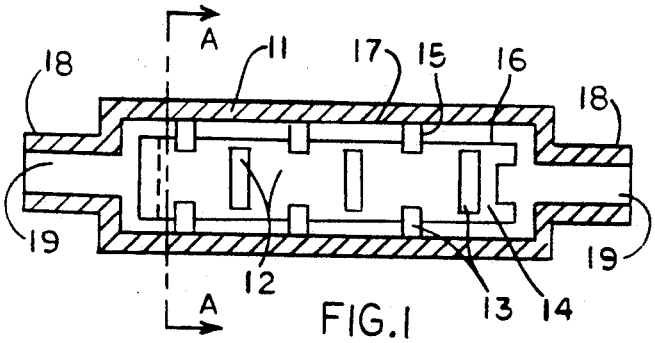
FIG. 1 is a partial cross section of a housing and a core.
Figure 2:
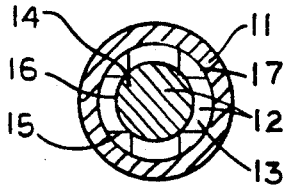
FIG. 2 is a section A—A of FIG. 1.

A housing 11 of FIG. 1 will be copper, aluminum, or an alloy with an inner surface 17, and will be a segment of a fuel line, with connections to the fuel line at its ends 18 wherein fuel will enter and exit through openings 19. A core 12, within the housing 11, has a center bar 14 with protrusions 13 having surfaces 16 and 15 respectively.

Figure 3:
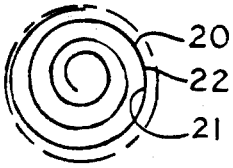
FIG. 3 is a coiled core, end view.
Figure 4:
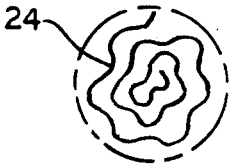
FIG. 4 is a corrugated coiled core, end view.

In FIG. 3 a core of rolled sheet or mesh 20 has an inner surface 21 and an outer surface 22; one, at lest, is coated or otherwise comprised of a group of elemental metals. FIG. 4 is a corrugated 24 form of FIG. 3, to provide a preset clearance.

Figure 5:
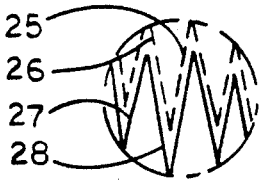
FIG. 5 is a pleated core, end view.

The core of FIG. 5 is pleated of one or more layers of metal sheet and/or metal mesh. Shown are two layers having surfaces 25 and 26, and 27 and 28.

Figure 6:
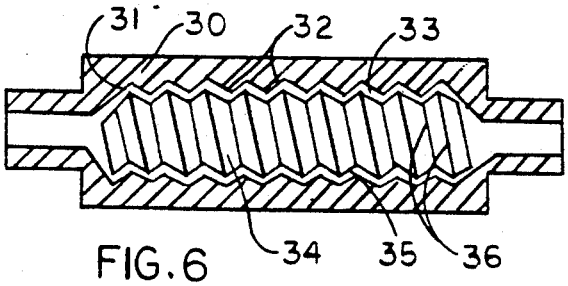
FIG. 6 is a partial cross section of a housing and a core.

The housing of FIG. 6 has an inner surface 31 of a screw thread form 32. A core 34 within the housing 30 has an exterior surface 35 of a screw thread form 36 which mates with the housing screw thread form 32, being assembled like a bolt and nut, with suitable clearance 33 for fuel flow.

Figure 7:
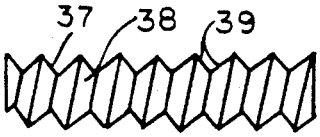
FIG. 7 is a core.

FIG. 7 is of a core 38 with an outer surface 37 and a left hand thread 39, opposite to the thread 32 of FIG. 6., and with an outer diameter sized to allow it to slide freely into housing 30.

Figure 8:
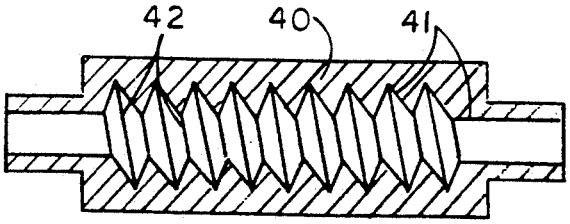
FIG. 8 is a cross section of a housing.

FIG. 8 is a housing 40 with an inner surface 41 in the form of a screw thread. This housing is used without a core, where appropriate, and has the inner surface of suitable elemental metals.

Figure 9:
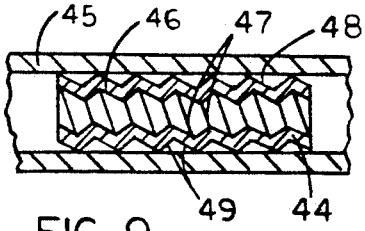
FIG. 9 is a cross section of a fuel line and a housing.

FIG. 9 is a housing 44 inserted within a fuel line 45, such as a non-conductive hose, with an inner surface 46 of thread form 47, and with an outer surface 48 of thread form 49.

Figure 10:
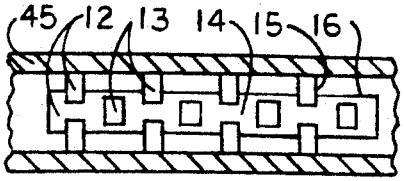
FIG. 10 is a partial cross section of a fuel line and a core.

FIG. 10 is a core 12, within a fuel line 45, with a center bar 14 with protrusions 13, having surfaces 16 and 15 respectively.

Figure 11:
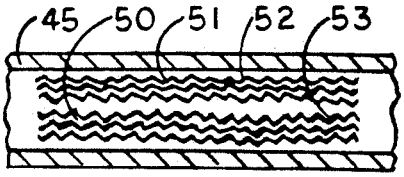
FIG. 11 is a cross section of a fuel line and a core.

FIG. 11 is a core 50, within a fuel line 45, having a metal sheet or mesh 51 with inner surface 53, and with outer surface 52. This core 50 comprises the cores of FIG. 3, FIG. 4, and FIG. 5, as they each are suitable for use within a fuel line, such as a hose.

A fuel treatment device will be comprised of one or more surfaces exposed to the fuel. Wherever there is more than one surface, the elemental metal content of each adjacent surface will usually be different from those presented to it; forming a passageway between them for the fuel flow, or, wherein the fuel flows past adjacent connecting surfaces. The elemental metals used in a device will be of only one group of metals, as defined.

At installation, the device will be isolated by nonconductive materials in the fuel line from nearby components.

A housing can be a component of a fuel line assembly, or it may be installed inside of a fuel line. A core will be either within a housing, or separately within a fuel line. The surfaces of the housing, and of the core, may form passageways; and can be a metal, an alloy; or, of a metallic or a nonmetallic material coated with a metallic surface. Adjacent surfaces may have the same, or different, metallic content within the parameters of the invention and the claims.

A helical form, as in FIG. 7, can be used separately within a fuel line. A preferred form has a rectangular sheet which will be diagonally corrugated such that when it is rolled into a coil, the corrugations form helical passageways. This embodiment may be installed within a housing, or within a fuel line as in FIG. 11.

The present invention can be applied to any form of a combustion engine; as well as to to the use of nonliquid fuels, including natural gas and ethane.

What is claimed is:

1. A liquid fuel treatment device for internal combustion engines comprising a core comprising a plurality of adjacent metallic surfaces, wherein a first metallic surface comprises an alloy comprising a plurality of elemental metals, and wherein a second metallic surface comprises an alloy comprising a plurality of elemental metals which differs in content from the said alloy comprising a first metallic surface.

2. The device of claim 1, wherein a first metallic surface comprises an alloy comprising silver, gold, aluminum, cobalt, iron, cadmium, and tin.

3. The device of claim 1, wherein a second metallic surface comprises an alloy comprising silver, copper, gold, aluminum, nickel, and zinc.

4. A liquid full treatment device for internal combustion engines comprising a core comprising a plurality of adjacent metallic surfaces, wherein a first metallic surface comprises an alloy comprising copper, gold, and silver, and wherein a second metallic surface comprises an alloy comprising aluminum, cobalt, and iron.

5. A liquid fuel treatment device for internal combustion engines comprising, a core with a metallic alloy surface comprising a plurality of elemental metals, and a housing with a metallic alloy surface comprising a plurality of elemental metals that differs in content from said metallic alloy surface of the core, wherein the core surface is adjacent to the housing surface and wherein said metallic alloy surface of the core comprises aluminum, cobalt, and iron, and wherein said metallic alloy surface of the housing comprises copper, gold, and silver.

6. The device of claim 5, wherein said metallic alloy surface of said core further comprises silver, gold, and cadmium.

7. The device of claim 5, wherein said metallic alloy surface of said housing further comprises aluminum, nickel, and zinc.

* * * * *